US009835149B2

(12) United States Patent
Mills

(10) Patent No.: US 9,835,149 B2
(45) Date of Patent: Dec. 5, 2017

(54) METHODS AND APPARATUS TO CALIBRATE ROD PUMP CONTROLLERS

(71) Applicant: Bristol, Inc., Watertown, CT (US)

(72) Inventor: Thomas Matthew Mills, Katy, TX (US)

(73) Assignee: Bristol, Inc., Houston, TX (US)

( * ) Notice: Subject to any disclaimer, the term of this patent is extended or adjusted under 35 U.S.C. 154(b) by 214 days.

(21) Appl. No.: 14/972,519

(22) Filed: Dec. 17, 2015

(65) Prior Publication Data

US 2017/0175732 A1 Jun. 22, 2017

(51) Int. Cl.

| | |
|---|---|
| ***G01R 35/00*** | (2006.01) |
| ***F04B 51/00*** | (2006.01) |
| ***E21B 43/12*** | (2006.01) |
| ***F04B 47/02*** | (2006.01) |
| ***E21B 47/00*** | (2012.01) |
| *G06F 11/30* | (2006.01) |

(52) U.S. Cl.

CPC ..... *F04B 51/00* (2013.01); *E21B 43/126* (2013.01); *E21B 43/127* (2013.01); *E21B 47/0008* (2013.01); *F04B 47/022* (2013.01)

(58) Field of Classification Search

CPC ..... F04B 51/00

See application file for complete search history.

(56) References Cited

U.S. PATENT DOCUMENTS

| | | | |
|---|---|---|---|
| 8,844,626 | B1 | 9/2014 | Krug |
| 2013/0024138 | A1 | 1/2013 | Mills |

FOREIGN PATENT DOCUMENTS

| | | |
|---|---|---|
| CA | 2767538 | 6/2013 |
| WO | 2013070979 | 5/2013 |

OTHER PUBLICATIONS

International Searching Authority, "International Search Report and Written Opinion", issued in connection with international application No. PCT/US2016/067225, dated Apr. 19, 2017 (14 pages).

*Primary Examiner* — Phuong Huynh

(74) *Attorney, Agent, or Firm* — Hanley, Flight & Zimmerman, LLC

(57) ABSTRACT

Methods and apparatus to calibrate rod pump controllers are described. An example method includes obtaining initial values related to a pumping unit, determining parameters based on the initial values, the parameters including at least one of a leaked off load value, a residual friction value, and a buoyant rod weight value, and based on one or more of the initial values and the parameters, calculating one or more dimensions of a rod string, the one or more dimensions to be used to determine a pump card of the pumping unit.

27 Claims, 3 Drawing Sheets

METHODS AND APPARATUS TO CALIBRATE ROD PUMP CONTROLLERS

FIELD OF THE DISCLOSURE

This patent relates generally to rod pumps and, more particularly, to methods and apparatus to calibrate rod pump controllers.

BACKGROUND

Pumping units are used to extract fluid (e.g., hydrocarbons) from a well or pump. Sucker rod strings are used in pumping unit wells to facilitate the pumping process.

SUMMARY

An example method includes obtaining initial values related to a pumping unit, determining parameters based on the initial values, the parameters including at least one of a leaked off load value, a residual friction value, and a buoyant rod weight value, and based on one or more of the initial values and the parameters, calculating one or more dimensions of a rod string, the one or more dimensions to be used to determine a pump card of the pumping unit.

Another example method includes based on valve checks, determining a leaked off load value for a pumping unit and a residual friction value for the pumping unit, based on the leaked off load value and the residual friction value, determining a buoyant rod weight value of a rod string of the pumping unit, and based on the buoyant rod weight value and the pump depth value, determining a rod diameter estimate of the rod string, the rod diameter estimate to be used to determine a pump card of the pumping unit or to verify an accuracy of values obtained by a rod pump controller.

An example apparatus includes a pumping unit to move a rod string, and a rod pump controller including a processor to obtain initial values related to the pumping unit, determine parameters based on the initial values, the parameters including at least one of a leaked off load value, a residual friction value, and a buoyant rod weight, and based on one or more of the initial values and determined parameters, calculate one or more dimensions of a rod string, the one or more dimensions to be used to calibrate the pumping unit, to determine a pump card of the pumping unit, or to verify an accuracy of values obtained by a rod pump controller.

Another example apparatus includes a housing and a processor positioned within the housing, the processor to obtain a pump depth value, perform valve checks, based on the valve checks, determine a leaked off load value for a pumping unit and a residual friction value for the pumping unit, based on the leaked off load value and the residual friction value, determine a buoyant rod weight value of a rod string of the pumping unit, and based on the buoyant rod weight value and the pump depth value, determine a rod diameter estimate of the rod string, the rod diameter estimate or an associated value to be used to calibrate the pumping unit or to verify an accuracy of the values at a rod pump controller.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
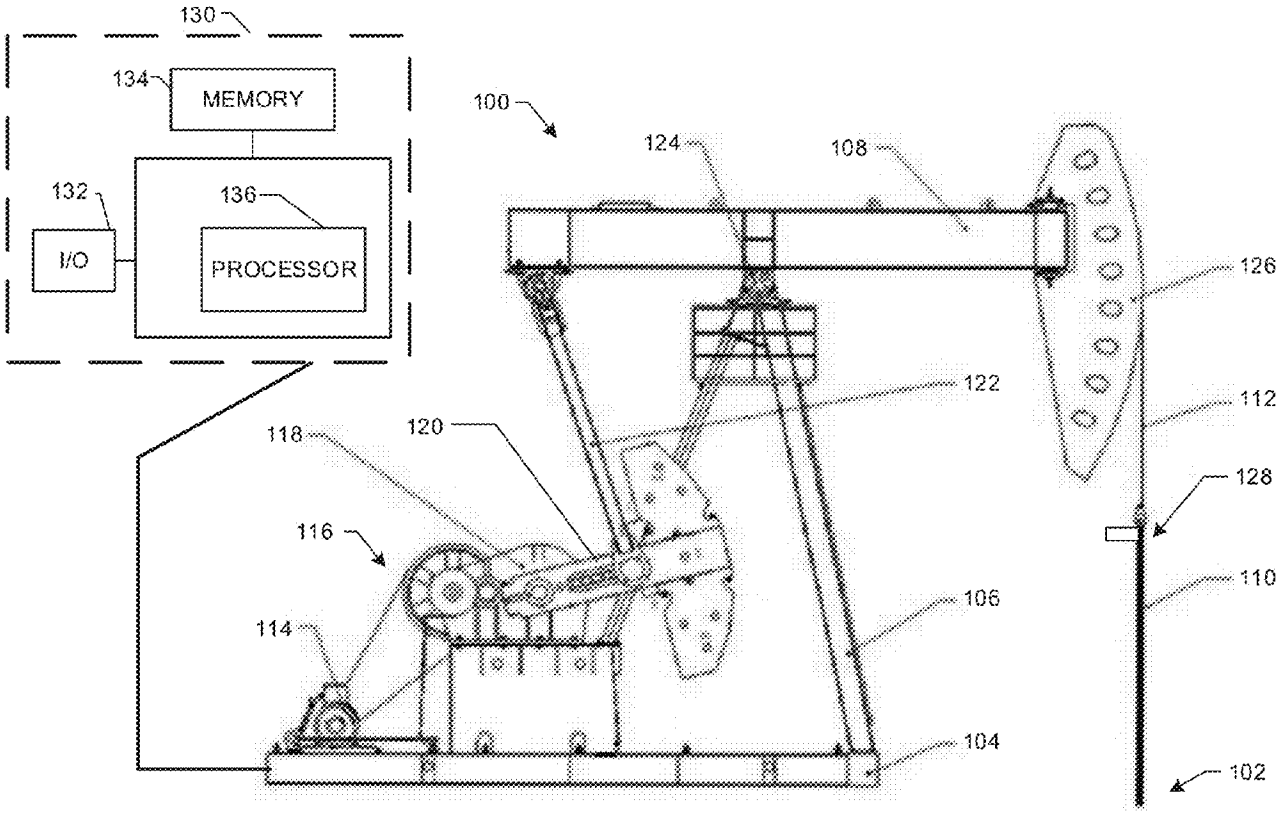
FIG. 1 illustrates an example pumping unit including an example rod pump controller.

The examples disclosed herein relate to calibrating example rod pump controllers and/or pump controllers of example pumping units including a sucker rod string and/or a rod string. The rod string may be a continuous series of rods having similar diameters or a series of rods having different diameters and/or tapered portions (e.g., three portions). In some examples, the rod string includes a series of tapered portions and/or rod string sections having different diameters, where a top tapered portion of the rod string includes rods having larger diameters than the rods in subsequent portions.

In some examples, to calibrate a rod pump controller, input values are obtained. In some examples, the values include one or more dimensions of the rod string obtained from an operator inputting values into the rod pump controller or by performing an example calibration process using the example pumping units and/or the example rod pump controllers disclosed herein. While the dimensions of the rod string and/or the pumping unit are sometimes entered by an operator, the dimensions of the rod string are not always immediately available to the operator. Specifically, when a rod pump controller is being commissioned and/or calibrated, the dimensions of the rod string and/or the dimensions of the different tapered portions of the rod string are not always immediately available to a technician commissioning and/or calibrating the pumping unit and/or the example rod pump controller. Without easy access to the dimensions of the rod string, completing the commissioning process is difficult or more time consuming for the operator. Even if the rod string dimensions are available and entered into the rod pump controller by the operator, confirming that the rod string dimensions are entered correctly may be time consuming.

In contrast to some examples, the examples disclosed herein relate to calibrating example rod pump controllers using estimated dimensions of the rod string. Thus, the examples disclosed herein enable the rod pump controllers to be calibrated and/or for down hole pump dynamometer cards to be computed even when the rod string dimensions are not available. Specifically, to simplify and/or expedite commissioning of the rod pump controllers, the examples disclosed herein enable rod pump controllers to determine and/or estimate the dimensions of the rod string installed in the well or pump, validate the rod string dimensions entered by the operator, and/or self-configure and/or determine the dimensions and/or data of the tapered portion of the rod string used in, for example, a pump dynamometer card calculation model. In some examples, the dimensions of the rod string include the length of the different tapered portions of the rod string, the diameter of the different tapered portions of the rod string, etc.

To determine the dimensions of the rod string, in some examples, some values related to the rod string are input into the rod pump controller by an operator installing the rod string and/or calibrating the rod pump controller. For example, an operator may provide an estimated pump depth and/or designate that the rod string is tapered or that the rod string has a relatively constant diameter. In some examples, such input values are used to enable the rod pump controller to estimate dimensions of the rod string, calibrate the pumping unit, and/or compute the pump dynamometer card.

To determine the dimensions of the rod string, in some examples, a traveling valve check(s) is performed to determine a leaked off traveling valve load (LOTVL) value and a standing valve check(s) is performed to determine a leaked off standing valve load (LOSVL) value. In some examples, a traveling valve check is performed by rapidly stopping the pumping unit during a latter portion of an upstroke of the pumping unit and observing and/or monitoring a polished rod load (e.g., weight, tension, force, etc.) as the polished rod load declines and/or stabilizes. In some examples, the stabilized load value from the traveling valve check corresponds to and/or is associated with the leaked off traveling valve load (LOTVL) [lbf] value. In some examples, a standing valve check is performed by stopping the pumping unit during a latter portion of a downstroke of the pumping unit and observing and/or monitoring the polished rod load until the polished rod load stabilizes. In some examples, the stabilized load determined from the standing valve check corresponds to and/or is associated with the leaked off standing valve load (LOSVL) [lbf] value.

In some examples, the calibration process includes determining a residual friction value using the leaked off traveling valve load value and the leaked off standing valve load value. In some examples, the calibration process includes determining a buoyant rod weight using one of the determined leaked off load values (e.g., the leaked off traveling valve load value or the leaked off standing valve load value) and/or the determined residual friction value. In some examples, weights of other components of the pumping unit (e.g., a rod string pump plunger) may be accounted for when determining the buoyant rod weight. However, in other examples, the weight of the other components of the pumping unit is not accounted for when determining the buoyant rod weight.

In some examples, a density of the sucker rod sting is determined using a weight and a length of a rod of the rod string. In some examples, the calibration process includes determining a diameter parameter value based on the buoyant rod weight and a pump depth estimate provided by the operator. An estimated diameter value of the one or more portions of the rod string may be determined using the diameter parameter value. In some examples, a first force value on the first portion of the rod string is estimated or determined using one or more of the determined values (e.g., the buoyant rod weight, the density, an estimated pump depth, and a cross-sectional area of the pump, etc.). Based on the first force value and the rod diameter parameter, in some examples, the calibration process includes determining the dimensions (e.g., a length, a diameter) of the one or more rod string portions.

After the dimensions of the rod string are estimated and/or determined, in some examples, the pump is operated to determine one or more parameter values that can be used in combination with the estimated rod string dimensions (e.g., a length, a diameter) to determine one or more pump cards, such as, for example, a pump dynamometer card. In some examples, rod pump controllers include features and/or can perform processes to determine the pump dynamometer card(s) using a mathematical model. To determine the pump card, in some examples, the mathematical model uses, for example, data measured at the surface and/or data and/or parameter values of the rod string installed in the pump. Thus, in the examples disclosed herein, the pump card can be calculated after the dimensions of the rod string are estimated using the example calibration process. In some examples, the pump card relates a position of the pumping unit to a load experienced by the pumping unit and is used to monitor an amount of fluid pumped by the pumping unit.

The examples disclosed herein can be used to validate data entered by an operator by, for example, estimating the rod string dimensions and comparing the estimated rod string dimensions to the rod string dimensions entered by the operator. If the estimated dimensions are inconsistent with the entered dimensions and/or if a difference between the estimated dimensions and the entered dimensions is outside of a threshold, in some examples, an alarm or alert is presented to the operator or otherwise to indicate a possible error and/or an inconsistency.

FIG. 1 shows an example crank arm balanced pumping unit and/or pumping unit 100 that can be used to produce oil from an oil well or pump 102. The pumping unit 100 includes a base 104, a Sampson post 106, and a walking beam 108. The walking beam 108 may be used to reciprocate a sucker rod string and/or rod string 110 relative to the pump 102 via a bridle 112. In some examples, the rod string 110 includes a continuous series of rods having the same or similar dimensions (e.g., diameters). In other examples, the rod string 110 includes a series of tapers (e.g., three tapered portions) and/or portions having different diameters, where a top portion (e.g., a first portion) has a number of rods having a first diameter larger than the diameters of the rods in subsequent portions (e.g., a second portion, a third portion) and the diameters of rods in the subsequent portions decrease accordingly. In some examples, a difference in a diameter between the first and second portions of the rod string is an ⅛ of an inch and a difference in a diameter between the second and third portions of the rod string is an ⅛ of an inch. In other words, adjacent portions of the rod string 110 may vary by ⅛ of an inch. However, in some examples, the change in diameter between the portions may be different. In some examples, the rods of the rod string 110 are made of steel. In other examples, the rods of the rod string 110 are made of other material(s), such as fiberglass. One or more sections and or portions of the rod string 110 may be made using rods of one or more different materials. For example, the top and bottom portions of the rod string 110 may be made of steel rods and the middle portion(s) of the rod string 110 may be made of fiberglass rods.

In some examples, the pumping unit 100 includes a motor or engine 114 that drives a belt and sheave system 116 to rotate a gear box 118 and, in turn, rotates a crank arm 120. A pitman 122 is coupled between the crank arm 120 and the walking beam 108 such that rotation of the crank arm 120 moves the pitman 122 and the walking beam 108. As the walking beam 108 pivots about a pivot point and/or a saddle bearing 124, the walking beam 108, in some examples, moves a horse head 126 and the rod string 110.

In some examples, to measure loads imparted on the rod string 110 and/or to determine a distance traveled by the rod string 110, a sensor 128 is located proximate to the rod string 110. In some examples, the sensor 128 is communicatively coupled to a rod pump controller 130 to enable data obtained from the sensor 128 to be communicated to the rod pump controller 130. The data may be received by, for example, an input/output (I/O) device 132 of the rod pump controller 130 and stored in a memory 134 that is accessible by a processor 136. For example, during the calibration process, the I/O device 132 and/or the processor 136 receive load values measured by the sensor 128. In some examples, an input (e.g., a sensor input, an operator input) may be received by the I/O device 132.

To calibrate the pumping unit 100 when the rod string 110 is placed in the pump 102, in some examples the I/O device 132 receives inputs and/or values from, for example, an operator and/or the sensor 128. Additional values may be accessible to the processor 136 via the memory 134 or values are stored in a database accessible via a communication network (e.g., the Internet, Intranet, etc.). To obtain the load values from the sensor 128, the rod pump controller 130 may, for example, perform one or more tests using the pumping unit 100. In some examples, the tests include at least one of a standing valve check or a traveling valve check.

In some examples, the load values include the leaked off traveling valve load value and the leaked off standing valve load value that are measured by the sensor 128 during the traveling valve check and the standing valve check, respectively. In some examples, a traveling valve check is performed by rapidly stopping the pumping unit 100 during a latter portion of an upstroke of the pumping unit 100 and observing and/or monitoring the polished rod load (e.g., weight, tension, force, etc.) as the polished rod load declines and stabilizes. In some examples, the stabilized load value from the traveling valve check corresponds to the leaked off traveling valve load (LOTVL) [lbf] value. In some examples, an uppermost joint of the rod string 110 corresponds to the polished rod which enables an efficient hydraulic seal to be made around the rod string 110.

In some examples, a standing valve check is performed by stopping the pumping unit 100 during a latter portion of a downstroke and observing and/or monitoring the polished rod load until the polished rod load stabilizes. In some examples, the stabilized load determined from the standing valve check is the leaked off standing valve load (LOSVL) [lbf] value. In some examples, the polished rod load may be measured by the sensor 128 located adjacent a polished rod of the rod string 110.

Based on the input values and/or the values obtained from the valve checks. etc. in some examples, the processor 136 determines a residual friction (RF) value. In some examples, the processor 136 uses Equation 1 to determine the residual friction value, where LOTVL corresponds to a leaked off traveling valve load value and LOSVL corresponds to a leaked off standing valve load value.

$$RF = LOTVL - LOSVL \quad \text{Equation 1:}$$

In other examples, the leaked off traveling valve load value and the leaked off standing valve load value are measured and/or determined by other processes and/or the residual friction value is determined using a different equation. In some examples, the leaked off traveling valve load value represents the buoyant weight of the rod string 110 plus the sum of Coulomb frictional forces on the system (e.g., the pump 102 and rod string 110). In some examples, the leaked off standing valve load value represents the buoyant weight of the rod string 110 minus the sum of Coulomb frictional forces on the system. Thus, in such examples, the difference between the leaked off traveling valve load value and the leaked off standing valve load value results in the residual friction value, as shown in Equation 1.

In some examples, the buoyant rod weight (WRF) can be calculated using the residual friction value and one of the leaked off traveling valve load or the leaked off standing valve load values. In some examples, the processor 136 uses either Equation 2 or Equation 3 to calculate the buoyant rod weight, where Equation 2 uses the leaked off traveling valve load value and the residual friction value to determine the buoyant rod weight and Equation 3 uses the leaked off standing valve load value and the residual friction to determine the buoyant rod weight.

$$WRF = LOTVL - 0.5 * RF \quad \text{Equation 2:}$$

$$WRF = LOSVL + 0.5 * RF \quad \text{Equation 3:}$$

In some examples, the leaked off traveling valve load value and the leaked off standing valve load value account for the weight of the rod string 110 and other components of the pumping assembly (e.g., a rod string pump plunger). In some examples, a refined buoyant rod weight ($WRF_{refined}$) is determined by subtracting the weight of the polished rod, the weight of the pump plunger, etc. from the buoyant rod weight. In some examples, Equation 4 is used by the processor 136 to determine the refined buoyant rod weight, where WOC corresponds to the estimated weight of the other components (e.g., the weight of the polished rod, the weight of the pump plunger, etc.) and WRF corresponds to the buoyant rod weight, which may be calculated by the processor 136 using, for example, Equation 3.

$$WRF_{refined} = WRF - WOC \quad \text{Equation 4:}$$

In some examples, the estimated weight of the other components may not be significant and, thus, the buoyant rod weight, WRF, determined using either Equation 2 or Equation 3, may be used instead. In the subsequent example equations, WRF and $WRF_{refined}$ may be used interchangeably.

In some examples, the pseudo-density ($\rho_A$) of the rod material in air can be calculated using information related to the rod string 110, such as weight, length, and diameter of the individual rods, where the rod string 110 is made up of a number of rods that are coupled together. In some examples, the processor 136 uses Equation 5 to determine the pseudo-density ($\rho_A$) of the rod material in air, where $W_R$ corresponds to a weight of a rod of the rod string 110 with couplings, $L_R$ corresponds to a length of the rod of the rod string 110 in feet, and $D_R$ corresponds to a diameter of the rod of the rod string 110 in inches.

$$\rho_A = \frac{W_R}{L_R * \frac{\pi}{576} * D_R} \quad \text{Equation 5}$$

In some examples, buoyant density ($\rho$) of the rod material is determined based on the pseudo-density ($\rho_A$) of the rod material in air. In some examples, the buoyant pseudo-density of the rod material is determined by the processor 136 using Equation 6, where $\rho_m$ corresponds to the density of the mixture in which the rod of the rod string 110 is placed. In some examples, the density of the mixture is approximately equal to the density of fresh water and, thus, the density ($\rho_m$) of the mixture can be assumed to be 62.4 [lb/ft$^3$].

$$\rho = \rho_A - \rho_m \quad \text{Equation 6:}$$

In some examples, a rod diameter parameter value (D') of the rod string 110 is determined based on at least one or more of the determined parameters (e.g., buoyant rod weight). In some examples, the processor 136 uses Equation 7 to determine the rod diameter parameter value, where PMD corresponds to the pump measured depth, $\rho$ corresponds to the buoyant density, and WRF corresponds to the buoyant rod weight. In some examples, the pump measured depth is input by the operator. In other examples, the pump measured depth is obtained from the memory 134 or some other database. In some examples, the PMD is entered into the I/O device 132 by an operator.

$$D' = \left(\frac{4 * WRF}{\rho * \pi * PMD}\right)^{.5} \quad \text{Equation 7}$$

In some examples, the rod diameter parameter value may not correspond to a standard diameter size of the rods of the rod string 110. Thus, in some examples, the rod diameter parameter value is rounded to the nearest ⅛ of an inch (0.010417 ft) to enable the estimated rod diameter parameter value to correspond to a standard rod string diameter value. In some examples, the processor 136 uses Equation 8 to round the rod diameter parameter value down to the nearest ⅛ of an inch, where D corresponds to the nominal diameter (e.g., the rounded diameter) in inches and D' corresponds to the diameter parameter value in inches. In Equation 8, INT implies rounding to the nearest integer value.

$$D = 0.010417 * \left(INT\left(\frac{D'}{0.010417} + .5\right)\right) \quad \text{Equation 8}$$

In examples in which the rod string 110 is a substantially constant diameter rod string 110, the nominal diameter corresponds to the diameter of all the rods in the constant diameter rod string 110. As used herein, a substantially constant diameter means that the diameters of the rods in the rod string 110 may vary approximately 3% from one another and/or accounts for manufacturing tolerances. If the processor 136 receives an input from the operator, via the I/O interface 132, indicating that the rod string 110 is a substantially constant diameter rod string 110, in some examples, the processor 136 uses Equation 9 to determine the length ($L_C$) of the rod string 110, where PMD corresponds to pump measured depth.

$$L_C = \text{PMD} \quad \text{Equation 9:}$$

In some examples, the processor 136 receives input, via the I/O device 132, indicating that the rod string 110 is tapered. Some rod strings 110 that are tapered have three portions. Equations 10-26 may be used when the rod string 110 is tapered and has three tapered portions. In other examples, the rod string 110 may have a different number of tapered portions and Equations 10-26 may be altered to account for the different number of tapered portions and/or fewer or additional equations may be used.

In examples in which the rod string 110 is tapered, the nominal rod diameter may be equal to the diameter of a portion of the rod string 110. In some examples, the rod string 110 has three tapered portions and the nominal rod diameter is equal to the diameter of a center portion of the rod string 110 (e.g., the second portion).

If the processor 136 receives an input from the operator indicating that the rod string 110 is tapered, and the rod string 110 includes a first portion, a second portion, and a third portion, the processor 136 may, for example, determine a first force value ($F_1$) on the first portion of the rod string 110 during the upstroke of the pumping unit 100. In some examples, Equation 10 is used by the processor 136 to determine the first force value, where WRF corresponds to the buoyant rod weight, $\rho_f$ corresponds to a density of a fluid in the tubing and/or the pump 102 in pounds per cubic food, PTVD corresponds to a pump true vertical depth (PTVD) in feet, and $A_p$ corresponds to the cross-sectional area of the pump 102 in square inches.

$$F_1 = WRF + \left(\frac{\rho_f * PTVD * A_p}{144}\right) + (.5 * RF) \quad \text{Equation 10}$$

In some examples, the cross-sectional area of the pump, the pump true vertical depth, and the density of a fluid in the tubing and/or the pump 102 may either be input by an operator or communicated to the processor 136 from, for example, the memory 134 or some other database. In some examples, the pump true vertical depth is estimated or calculated. In some examples, the pump true vertical depth corresponds to the pump measured depth.

In some examples, the length ($L_1$) of the first portion of the rod string 110 is determined. In some examples, the processor 136 uses Equation 11 to determine the length of the first portion of the rod string 110 that is tapered, where D corresponds to the nominal diameter of the rod string 110 and ρ corresponds to the buoyant density of the rod string 110.

$$L_1 = \frac{F_1\left(1 - \frac{D^2}{(D + 0.0104)^2}\right)}{\frac{\pi}{4} * \rho * (D + 0.0104)^2} \quad \text{Equation 11}$$

In some examples, the diameter ($D_1$) of the first portion of the rod string 110 that is tapered is determined. In some examples, the first portion includes a number of rods. In some examples, the processor 136 uses Equation 12 to determine the diameter of the first portion of the rod string 110 that is tapered, where D corresponds to the nominal diameter.

$$D_1 = D + 0.0104 \quad \text{Equation 12:}$$

In some examples, the cross-sectional area ($A_1$) of the first portion of the rod string 110 may be determined. In some examples, the processor 136 uses Equation 13 to determine the cross-sectional area of the first portion of the rod string 110, where $D_1$ corresponds to the diameter of the first portion of the rod string 110.

$$A_1 = \frac{\pi}{4} * D_1^2 \quad \text{Equation 13}$$

In some examples, the length ($L_2$) of the second portion of the rod string 110 is calculated. In some examples, the processor 136 uses Equation 14 to determine the length of the second portion of the rod string 110.

$$L_2 = \frac{4 * F_1(0.0280 * D - 0.000109)}{\pi * \rho * D^2 * (D + 0.0104)^2} \quad \text{Equation 14}$$

In some examples, the diameter ($D_2$) of the second portion of the rod string 110 that is tapered is calculated. In some examples, the second portion includes a number of rods. In such examples, the processor 136 uses Equation 15 to determine the diameter of the second portion of the rod string 110.

$$D_2=D \quad \text{Equation 15:}$$

In some examples, the cross-sectional area ($A_2$) of the second portion of the rod string 110 is determined. In some examples, the processor 136 uses Equation 16 to determine the cross-sectional area ($A_2$) of the second portion of the rod string 110, where $D_2$ corresponds to the diameter of the second portion of the rod string 110.

$$A_2 = \frac{\pi}{4} * D_2^2 \quad \text{Equation 16}$$

If the different tapered portions of the rod string 110 are constructed of the same or substantially the same material, in some examples, the forces at the top of each tapered portion can be determined. In some examples, the processor 136 uses Equation 17 to calculate the force ($F_2$) at the top of the second portion, where $A_1$ corresponds to the cross-sectional area of the first portion of the rod string 110, $F_1$ corresponds to a force value on the first portion of the rod string 110, and $L_1$ corresponds to the length of the first portion of the rod string 110.

$$F_2=F_1-(A_1*L_1*\rho) \quad \text{Equation 17:}$$

In examples where the rod string 110 is tapered, the sum of the lengths of each tapered portion corresponds to the pump measured depth (PMD). For example, if the rod string 110 has three tapered portions, Equation 18 can be used to correlate the lengths of the first, second, and third portions of the rod string 110 and the pump measured depth, where $L_1$ corresponds to the length of the first portion, $L_2$ corresponds to the length of the second portion, and $L_3$ corresponds to a length of the third portion.

$$L_1+L_2+L_3=\text{PMD} \quad \text{Equation 18:}$$

In some examples, the length ($L_3$) of the third portion of the rod string 110 is calculated. In some examples, the processor 136 uses Equation 19 to determine the length of the third portion of the rod string 110. In Equation 19, Equation 18 is rearranged to solve for $L_3$.

$$L_3=\text{PMD}-L_1-L_2 \quad \text{Equation 19:}$$

In some examples, the diameter ($D_3$) of the third portion of the rod string 110 that is tapered is calculated. In some examples, the third portion includes a number of rods. In some examples, the processor 136 uses Equation 20 to determine the diameter of the third portion of the rod string 110.

$$D_3=D-0.0104 \quad \text{Equation 20:}$$

In some examples, the cross-sectional area ($A_3$) of the third portion of the rod string 110 is determined. In some examples, the processor 136 uses Equation 21 to determine the cross-sectional area of the third portion of the rod string 110.

$$A_3 = \frac{\pi}{4} * D_3^2 \quad \text{Equation 21}$$

In some examples, the force ($F_3$) at the top of the third portion is determined. For example, the processor 136 can use Equation 22 to calculate the force at the top of the third portion, where $F_2$ corresponds to the force at the top of the second portion. $L_2$ corresponds to the length of a second portion, $A_3$ corresponds to cross-sectional area of the third portion of the rod string 110, and ρ is the buoyant density of the rod string 110.

$$F_3=F_2-(A_2*L_2*\rho) \quad \text{Equation 22:}$$

In some examples, all of the tapered portions in the rod string 110 are constructed of the same and/or substantially the same material (e.g., steel). If all of the tapered portions of the rod string 110 are constructed of similar or the same material and the rod string 110 includes three portions having different diameters, Equation 23 can be used to relate the areas and lengths of each of the three tapered portions of the rod string 110 to the buoyant rod weight and the buoyant rod density (ρ). As set forth herein, similar material means that there may be some variations in the material due to manufacturing tolerances. In examples where the rod string 110 has more than three tapered portions, Equation 23 may be altered accordingly.

$$(A_1 * L_1) + (A_2 * L_2) + (A_3 * L_3) = \frac{WRF}{\rho} \quad \text{Equation 23}$$

Rod string design strategies vary but, in some examples, an "equal stress" strategy is used to design the example rod string 110. In such examples, the lengths of the tapered portions are chosen so that the stresses at the top of each tapered portion of the rod string 110 are substantially equal. As used herein, substantially equal stress means that the stress of each tapered portion may vary approximately 3% from one another. Thus, in some examples, Equation 24, Equation 25, and Equation 26 can be used to relate the force at a top of a portion of the rod string 110 and the cross-sectional area of the portion to the force at a top of another portion of the rod string 110 and the cross-sectional area of the other portion of the rod string 110. For example, Equation 24 relates the force at the top of the first portion of the rod string 110 and the cross-sectional area of the first portion of the rod string 110 to the force at the top of the second portion of the rod string 110 and the cross-sectional area of the second portion of the rod string 110. Equation 25 relates the force at the top of the first portion of the rod string 110 and the cross-sectional area of the first portion of the rod string 110 to the force at the top of the third portion of the rod string 110 and the cross-sectional area of the third portion of the rod string 110. Equation 26 relates the force at the top of the second portion of the rod string 110 and the cross-sectional area of the second portion of the rod string 110 to the force at the top of the third portion of the rod string 110 and the cross-sectional area of the third portion of the rod string 110.

$$\frac{F_1}{A_1} = \frac{F_2}{A_2} \quad \text{Equation 24}$$

$$\frac{F_1}{A_1} = \frac{F_3}{A_3} \quad \text{Equation 25}$$

$$\frac{F_2}{A_2} = \frac{F_3}{A_3} \quad \text{Equation 26}$$

In some examples, the processor 136 generates a report including the dimensions (e.g., length and diameter) of each portion of the rod string 110. The report may be used by an operator to later validate the estimated measurements when the actual measurements are available to the operator. The determined dimensions of the rod string 110 are used to calibrate the pumping unit 100.

Once the calibration of the pumping unit 100 is complete and/or the corresponding report is generated, the determined dimensions of the rod string 110 may be stored in the memory 134 and/or used by the processor 136 to generate, for example, a dynamometer card (e.g., a rod pump dynamometer card, a surface dynamometer card, a pump dynamometer card, etc.). In some examples, the dynamometer cards are used during the operation of the pumping unit 100.

In some examples, the values obtained during the calibration are used, for example, to validate operator entered values or other data. For example, to verify accuracy of the numbers entered by the operator values for the dimensions of the first, second, and third tapered portions of the rod string 110 can be compared, via the processor 136, to corresponding values entered into the processor 136, via the I/O interface 132, by an operator to determine if the operator entered values are outside of a threshold. If the values are outside of a threshold, the example processor 136 may causes an alert to be displayed via, for example, an I/O device 132, or otherwise communicated. Thus, the examples disclosed herein may be used to verify the accuracy of operator inputs and/or the values determined using the examples disclosed herein may be used to calibrate the pumping unit 100 and/or the rod pump controller 130.

While an example manner of implementing the pumping unit 100 is illustrated in FIG. 1, one or more of the elements, processes and/or devices illustrated in FIG. 1 may be combined, divided, re-arranged, omitted, eliminated and/or implemented in any other way. Further, the example processor 136, the example I/O device 132, the example memory 134 and/or, more generally, the example rod pump controller 130 of FIG. 1 may be implemented by hardware, software, firmware and/or any combination of hardware, software and/or firmware. Thus, for example, any of the example processor 136 the example I/O device 132, the example memory 134 and/or, more generally, the example rod pump controller 130 could be implemented by one or more circuit(s), programmable processor(s), application specific integrated circuit(s) (ASIC(s)), programmable logic device(s) (PLD(s)) and/or field programmable logic device(s) (FPLD(s)), etc. When reading any of the apparatus or system claims of this patent to cover a purely software and/or firmware implementation, at least one of the example processor 136 the example I/O device 132, the example memory 134 and/or, more generally, the example rod pump controller 130 are hereby expressly defined to include a tangible computer readable storage device or storage disc such as a memory. DVD, CD, Blu-ray, etc. storing the software and/or firmware. Further still, the example pumping unit 100 of FIG. 1 may include one or more elements, processes and/or devices in addition to, or instead of, those illustrated in FIG. 3, and/or may include more than one of any or all of the illustrated elements, processes and devices.

Figure 2:
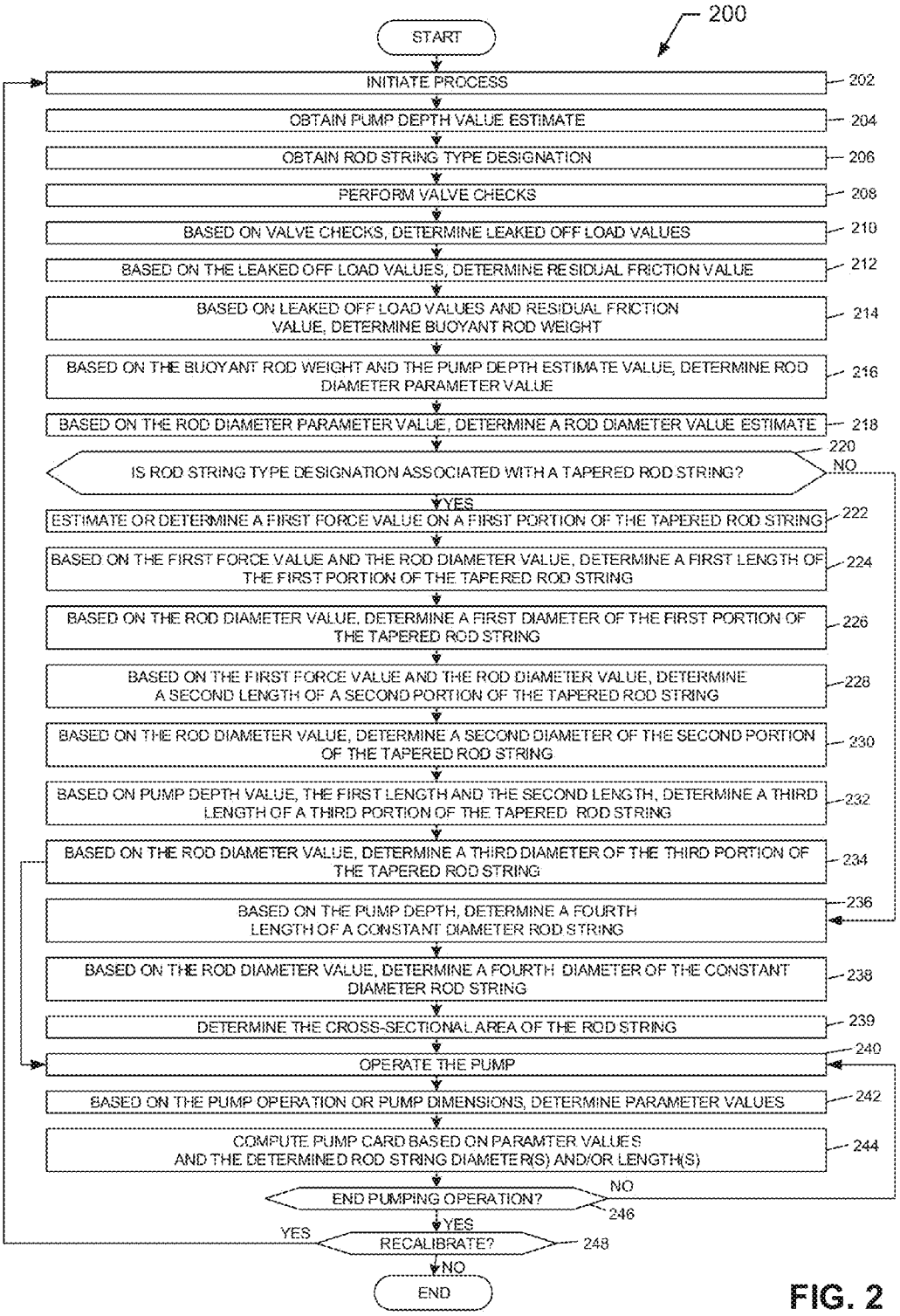
FIG. 2 is an example flowchart representative of a method that may be used to implement the example pumping unit described herein.

A flowchart representative of an example method 200 that may be used to implement the pumping unit 100 of FIG. 1 is shown in FIG. 2. In this example, the method 200 may be implemented using machine readable instructions that comprise a program for execution by a processor such as the processor 312 shown in the example processor platform 300 discussed below in connection with FIG. 3. The program may be embodied in software stored on a tangible computer readable storage medium such as a CD-ROM, a floppy disk, a hard drive, a digital versatile disk (DVD), a Blu-ray disk, or a memory associated with the processor 312, but the entire program and/or parts thereof could alternatively be executed by a device other than the processor 312 and/or embodied in firmware or dedicated hardware. Further, although the example program is described with reference to the flowchart illustrated in FIG. 2, many other methods of implementing the example pumping unit 100 may alternatively be used. For example, the order of execution of the blocks may be changed, and/or some of the blocks described may be changed, eliminated, or combined.

As mentioned above, the example method 200 of FIG. 2 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIG. 2 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disc and to exclude propagating signals. As used herein, when the phrase "at least" is used as the transition term in a preamble of a claim, it is open-ended in the same manner as the term "comprising" is open ended.

The example method 200 of FIG. 2 begins when a calibration process is initiated (block 202) by for example, inserting the rod string 110 into the pump 102 of the pumping unit 100, pushing a button or actuating a physical object (e.g., a lever) to cause the rod pump controller 130 to run the calibration process. In some examples, during the initiation of the calibration process, the operator inputs values used in the calibration process, such as dimensions of the pump, dimensions of a rod of the rod string 110, etc. The pump depth value estimate is obtained (block 204) using, for example, the processor 136 to estimate or calculate the pump depth of the pumping unit 100 and/or by receiving an input at the I/O device 132 from the operator. The rod string type designation is obtained (block 206) using, for example, the processor 136 and/or an input at the I/O device 132 from the operator.

Valve checks are performed (block 208), a using, for example, the rod pump controller 130 and/or the sensor 128 to perform a standing valve check(s) and a traveling valve check(s). Based on the valve checks, the leaked off load values are determined (block 210) using, for example, the sensor 128 located on the pumping unit 100 proximate to the rod string 110 to measure the leaked off load values during the valve checks. In some examples, the sensor 128 provides the leaked off load values to the processor 136 via the I/O device 132.

Based on the leaked off load values, the residual friction value is determined (block 212) using, for example, the rod controller 130, the processor 136, and/or Equation 1. The buoyant rod weight is determined based on the determined leaked off load values and the residual friction value (block 214) using, for example, the rod controller 130, the processor 136, Equation 2, and/or Equation 3. In some examples, a refined buoyant rod weight is determined by subtracting estimated weights of other components in the system (e.g., polished rod, etc.) using, for example, Equation 4. In some examples, the buoyant density of the rod string 110 is calculated based on the buoyant rod weight and rod parameters provided by, for example, the rod manufacturer and/or using Equation 5 and Equation 6.

A rod diameter parameter value is determined based on the pump depth estimate value, the buoyant rod weight, and the buoyant rod density (block 216) using, for example, the rod controller 130, the processor 136, and/or Equation 7. Based on the rod diameter parameter value, a rod diameter value estimate is determined (block 218) using, for example, the rod controller 130, the processor 136, and/or Equation 8 to round the rod diameter parameter down to, for example, the nearest ⅛ of an inch.

The process determines if the rod string designation is associated with the rod string being tapered (block 220) based on, for example, and input to the I/O device 132 from the operator. If the rod string 110 is designated as a tapered rod string, the rod string 110 may have three tapered portions. If the rod string 110 is designated as a constant diameter rod string, each rod in the rod string 110 has, for example, the same or a similar diameter.

If the rod string designation is a tapered rod string, a first force value on a first portion of the rod string 110 is estimated or determined (block 222) using, for example, the buoyant rod weight, the pump depth, a cross-sectional area of the pump, and a density of the fluid in the tubing, and/or Equation 10. Based on the first force value and the rod diameter value, a first length of the first portion of the rod string 110 is determined (block 224) using, for example, the processor 136, the first force value, and/or Equation 11. Based on the rod diameter value, a first diameter of the first portion of the rod string 110 is determined (block 226) using, for example, the processor 136, the first length, and/or Equation 12.

Based on the first force value and the rod diameter value, a second length of the second portion of rod string 110 is determined (block 228) using, for example, the processor 136, the first force value, the diameter value, and/or Equation 14. Based on the rod diameter value, a second diameter of the second portion of the rod string 110 is determined (block 230) using, for example, the processor 136, the second length, and/or Equation 15. If the rod string 110 has three tapered portions, the diameter of the second portion of the rod string 110 is, for example, the nominal diameter calculated in Equation 8.

Based on a pump depth value, the first length, and the second length, a third length of the third portion of the rod string 110 is determined (block 232) using, for example, the processor 136, and/or Equation 19. Based on the rod diameter value, a third diameter of the third portion of the rod string 110 is determined (block 234) using, for example, the processor 136, the length of the third tapered portion, and/or Equation 20.

If the rod string designation is not a tapered rod string, but is instead a constant diameter rod string, based on the pump depth, a fourth length of a rod string 110 is determined (block 238) using, for example, the processor 136, the pump depth, and/or Equation 9. Based on the rod diameter value, a fourth diameter of the rod string 110 having a constant diameter is determined (block 238) using, for example, the processor 136 and/or the nominal diameter determined in Equation 8.

In some examples, the cross-sectional area of the rod string 110 and/or each portion of the rod string 110 is determined based on the diameter(s) of the rod string 110 (block 239). In some examples, the cross-sectional area of the rods in the first, second, and third portions are determined by the processor 136 using Equation 13, Equation 16, and Equation 21, respectively. In other examples, such as when the rod string 110 is designated as a constant diameter rod string, the cross-sectional area is determined by, for example, Equation 16. In some examples, the processor 136 generates a report of the dimensions of the rod string 110.

After the dimensions of the rod string 110 are determined, the pumping unit 100 is operated (block 240). Based on the pump operation and/or the pump dimensions, parameter values for the pump 102 are determined (block 242) using, for example, processor 136. The pump card is computed based on the parameter values and the determined rod string diameter(s) and/or length(s) (block 244) using, for example, the processor 136. The processor 136 then determines if the pumping operation should end (block 246). If the pumping operation should not end, the process returns to block 240. If the pumping operation should end, the processor 136 determines if the pumping unit 100 is to be recalibrated (block 248). If the pumping unit 100 needs to be recalibrated, the process returns to block 202. If the pumping unit 100 is not to be recalibrated, the process ends.

Figure 3:
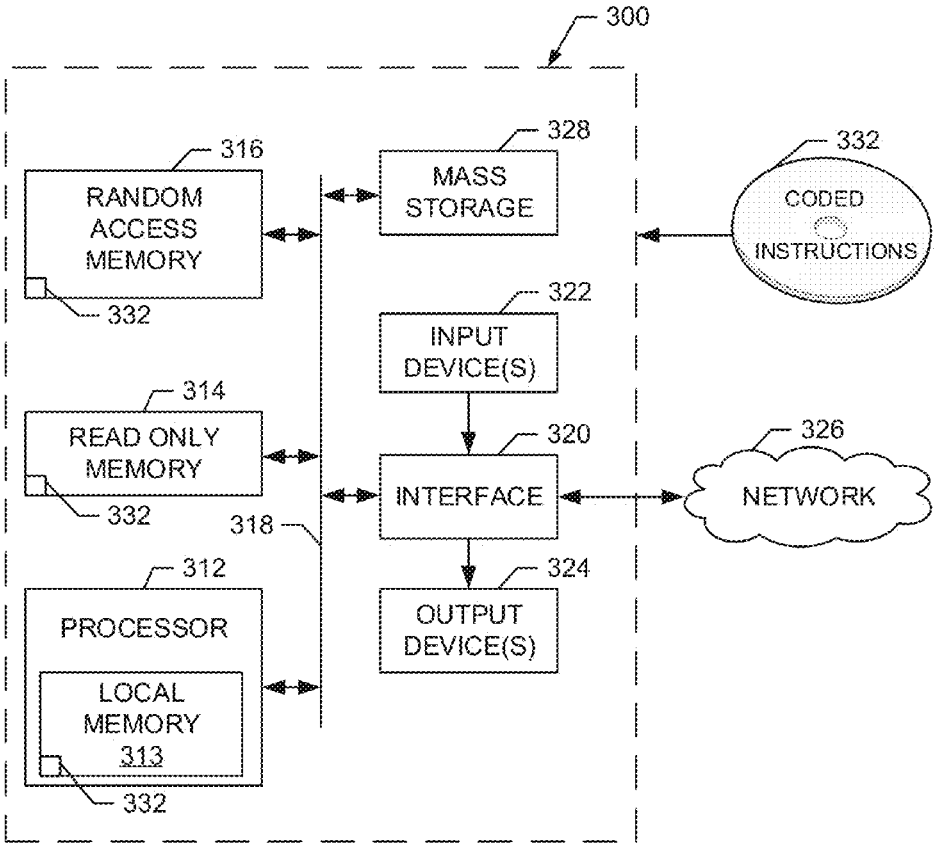
FIG. 3 is a processor platform to execute instructions to implement the method of FIG. 2 and/or the example pumping unit of FIG. 1.

FIG. 3 is a block diagram of an example processor platform 300 capable of executing instructions to implement the method 200 of FIG. 2 and the example pumping unit 100 of FIG. 1. The processor platform 300 can be, for example, a server, a personal computer, a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, or any other type of computing device.

The processor platform 300 of the illustrated example includes a processor 312. The processor 312 of the illustrated example is hardware. For example, the processor 312 can be implemented by one or more integrated circuits, logic circuits, microprocessors or controllers from any desired family or manufacturer.

The processor 312 of the illustrated example includes a local memory 313 (e.g., a cache). The processor 312 of the illustrated example is in communication with a main memory including a volatile memory 314 and a non-volatile memory 316 via a bus 318. The volatile memory 314 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 316 may be implemented by flash memory and/or any other desired type of memory device. Access to the main memory 314, 316 is controlled by a memory controller.

The processor platform 300 of the illustrated example also includes an interface circuit 320. The interface circuit 320 may be implemented by any type of interface standard, such as an Ethernet interface, a universal serial bus (USB), and/or a PCI express interface.

In the illustrated example, one or more input devices 322 are connected to the interface circuit 320. The input device(s) 322 permit a user to enter data and commands into the processor 312. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 324 are also connected to the interface circuit 320 of the illustrated example. The output devices 324 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 320 of the illustrated example, thus, typically includes a graphics driver card.

The interface circuit 320 of the illustrated example also includes a communication device such as a transmitter, a receiver, a transceiver, a modem and/or network interface card to facilitate exchange of data with external machines (e.g., computing devices of any kind) via a network 326 (e.g., an Ethernet connection, a digital subscriber line (DSL), a telephone line, coaxial cable, a cellular telephone system, etc.).

The processor platform 300 of the illustrated example also includes one or more mass storage devices 328 for storing software and/or data. Examples of such mass storage devices 328 include floppy disk drives, hard drive disks, compact disk drives, Blu-ray disk drives, RAID systems, and digital versatile disk (DVD) drives.

Coded instructions 332 to implement the method of FIG. 2 may be stored in the mass storage device 328, in the volatile memory 314, in the non-volatile memory 316, and/or on a removable tangible computer readable storage medium such as a CD or DVD.

From the foregoing, it will be appreciated that the above disclosed methods, apparatus and articles of manufacture increase the efficiency at which pumping units can be calibrated when a rod string is installed. Further, using the examples disclosed herein, an operator or technician can calibrate the rod pump controllers without having access to the dimensions of the rod string, which may not always be readily accessible. Further, the examples disclosed herein enable a validation of any dimensions input by the technician or operator.

An example method includes obtaining initial values related to a pumping unit, determining parameters based on the initial values, the parameters including at least one of a leaked off load value, a residual friction value, and a buoyant rod weight value, and based on one or more of the initial values and the parameters, calculating one or more dimensions of a rod string, the one or more dimensions to be used to determine a pump card of the pumping unit.

In some examples, the method includes calibrating the pumping unit based on the one or more dimensions. In some examples, the leaked off load value is a first leaked off load value, and the method further includes determining a second leaked off load value, where determining the first and second leaked offload values includes executing one or more valve checks. In some examples, the method includes obtaining a rod string designation associated with a tapered rod string or a constant diameter rod string. In some such examples, the method includes calculating, based on the rod string designation, the one or more initial values, and the one or more parameters, or a force value on a first portion of the tapered rod string. In some such examples, the method includes determining, based on the one or more initial values and the one or more parameters, one or more dimensions for the first portion of the tapered rod string, the one or more dimensions including a diameter of the first portion or a length of the first portion. In some examples, the method includes operating the pump to determine one or more pump operating parameter values, the one or more pump operating parameter values associated in defining the pump card. In some examples, the method includes generating a report of the one or more dimensions of the sucker rod string. In some such examples, the method includes the buoyant rod weight is determined based on the leaked off load values and the residual friction.

Another example method includes based on valve checks, determining a leaked off load value for a pumping unit and a residual friction value for the pumping unit, based on the leaked off load value and the residual friction value, determining a buoyant rod weight value of a rod string of the pumping unit, and based on the buoyant rod weight value and the pump depth value, determining a rod diameter estimate of the rod string, the rod diameter estimate to be used to determine a pump card of the pumping unit or to verify an accuracy of values obtained by a rod pump controller.

In some examples, the method includes obtaining a rod string designation, the rod string designation being associated with a tapered rod string or a constant diameter rod string. In some examples, the method includes determining a first force value of a first portion of the rod string. In some such examples, the first force value is determined based on one or more of the rod diameter estimate, the buoyant rod weight, a pump depth value, or the residual friction value. In some such examples, the method includes, based on the first force value and the rod diameter estimate, determining a first length of the first portion. In some such examples, the method includes, based on the first force value and the rod diameter estimate, determining a second length of a second portion of the rod string. In some examples, the method includes, based on the first length of the first portion and the second length of the second portion, determining a third length of a third portion of the rod string. In some examples, the method includes, based on the rod diameter estimate, determining a first diameter of the first portion. In some such examples, the method includes, based on the rod diameter estimate, determining a second diameter of a second portion of the rod string. In some examples, the method includes, based on the rod diameter estimate, determining a third diameter of a third portion of the rod string. In some examples, the method includes determining a length of the rod string based on the pump depth value and determining a diameter of the rod string based on the rod diameter estimate.

An example tangible machine readable storage device or storage disc includes machine readable instructions that, when executed, cause a processor to at least obtain initial values, the initial values related to a pumping unit, determine parameters based on the initial values, the parameters including at least one of a leaked off load value, a residual friction value, and a buoyant rod weight, and based on one or more of the initial values and the determined parameters, calculate one or more dimensions of a rod string, the one or more dimensions to be used to determine a pump card of the pumping unit or to verify an accuracy of values obtained by a rod pump controller.

In some examples, the instructions cause the processor to calibrate the pumping unit based on the one or more dimensions. In some examples, the instructions cause the processor to generate a report of the one or more dimensions of the rod string.

An example apparatus includes a pumping unit to move a rod string, and a rod pump controller including a processor to obtain initial values related to the pumping unit, determine parameters based on the initial values, the parameters including at least one of a leaked off load value, a residual friction value, and a buoyant rod weight, and based on one or more of the initial values and determined parameters, calculate one or more dimensions of a rod string, the one or more dimensions to be used to calibrate the pumping unit, to determine a pump card of the pumping unit, or to verify an accuracy of values obtained by a rod pump controller.

Another example apparatus includes a housing and a processor positioned within the housing, the processor to obtain a pump depth value, perform valve checks, based on the valve checks, determine a leaked off load value for a pumping unit and a residual friction value for the pumping unit, based on the leaked off load value and the residual friction value, determine a buoyant rod weight value of a rod string of the pumping unit, and based on the buoyant rod weight value and the pump depth value, determine a rod diameter estimate of the rod string, the rod diameter estimate or an associated value to be used to calibrate the pumping unit or to verify an accuracy of the values at a rod pump controller.

In some examples, the processor is to obtain a rod string designation associated with a tapered rod string or a constant diameter rod string. In some examples, the processor is to obtain a diameter of a portion of the rod string based on the rod diameter estimate. In some examples, the processor is to determine a second dimension of the rod string, wherein the second dimension includes a length based on the rod diameter estimate and the pump depth value.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method, comprising:

obtaining initial values related to a pumping unit;

determining parameters based on the initial values, the parameters including at least one of a leaked off load value, a residual friction value, and a buoyant rod weight value; and based on one or more of the initial values and the parameters, calculating one or more dimensions of a rod string, the one or more dimensions to be used to determine a pump card of the pumping unit.

2. The method of claim 1, further including calibrating the pumping unit based on the one or more dimensions.

3. The method of claim 1, wherein the leaked offload value is a first leaked off load value, and further including determining a second leaked off load value, wherein determining the first and second leaked offload values includes executing one or more valve checks.

4. The method of claim 1, further including obtaining a rod string designation associated with a tapered rod string or a constant diameter rod string.

5. The method of claim 4, further including calculating, based on the rod string designation, the one or more initial values, and the one or more parameters, or a force value on a first portion of the tapered rod string.

6. The method of claim 5, further including determining, based on the one or more initial values and the one or more parameters, one or more dimensions for the first portion of the tapered rod string, the one or more dimensions including a diameter of the first portion or a length of the first portion.

7. The method of claim 1, further including generating a report of the one or more dimensions of the sucker rod string.

8. The method of claim 3, wherein the buoyant rod weight is determined based on the leaked off load values and the residual friction.

9. A method, comprising:

based on valve checks, determining a leaked off load value for a pumping unit and a residual friction value for the pumping unit;

based on the leaked off load value and the residual friction value, determining a buoyant rod weight value of a rod string of the pumping unit; and based on the buoyant rod weight value and the pump depth value, determining a rod diameter estimate of the rod string, the rod diameter estimate to be used to determine a pump card of the pumping unit or to verify an accuracy of values obtained by a rod pump controller.

10. The method of claim 9, further including obtaining a rod string designation, the rod string designation being associated with a tapered rod string or a constant diameter rod string.

11. The method of claim 9, further including determining a first force value of a first portion of the rod string.

12. The method of claim 11, wherein the first force value is determined based on one or more of the rod diameter estimate, the buoyant rod weight, a pump depth value, or the residual friction value.

13. The method of claim 11, further including, based on the first force value and the rod diameter estimate, determining a first length of the first portion.

14. The method of claim 13, further including, based on the first force value and the rod diameter estimate, determining a second length of a second portion of the rod string.

15. The method of claim 14, further including, based on the first length of the first portion and the second length of the second portion, determining a third length of a third portion of the rod string.

16. The method of claim 11, further including, based on the rod diameter estimate, determining a first diameter of the first portion.

17. The method of claim 11, further including, based on the rod diameter estimate, determining a second diameter of a second portion of the rod string.

18. The method of claim 11, further including, based on the rod diameter estimate, determining a third diameter of a third portion of the rod string.

19. The method of claim 10, further including determining a length of the rod string based on the pump depth value and determining a diameter of the rod string based on the rod diameter estimate.

20. A non-transitory machine readable storage device or storage disc comprising machine readable instructions that, when executed, cause a processor to at least:

obtain initial values, the initial values related to a pumping unit;

determine parameters based on the initial values, the parameters including at least one of a leaked off load value, a residual friction value, and a buoyant rod weight; and based on one or more of the initial values and the determined parameters, calculate one or more dimensions of a rod string, the one or more dimensions to be used to determine a pump card of the pumping unit or to verify an accuracy of values obtained by a rod pump controller.

21. The non-transitory machine readable storage device or storage disc as defined in claim 20, wherein the machine readable instructions, when executed, cause the processor to calibrate the pumping unit based on the one or more dimensions.

22. The non-transitory machine readable storage device or storage disc as defined in claim 20, wherein the machine readable instructions, when executed, cause the processor to generate a report of the one or more dimensions of the rod string.

23. An apparatus, comprising:

a pumping unit to move a rod string; and a rod pump controller including a processor to:

obtain initial values related to the pumping unit;

determine parameters based on the initial values, the parameters including at least one of a leaked off load value, a residual friction value, and a buoyant rod weight; and based on one or more of the initial values and determined parameters, calculate one or more dimensions of a rod string, the one or more dimensions to be used to calibrate the pumping unit, to determine a pump card of the pumping unit, or to verify an accuracy of values obtained by a rod pump controller.

24. An apparatus comprising:

a housing; and a processor positioned within the housing, the processor to:

obtain a pump depth value;

perform valve checks;

based on the valve checks, determine a leaked off load value for a pumping unit and a residual friction value for the pumping unit;

based on the leaked off load value and the residual friction value, determine a buoyant rod weight value of a rod string of the pumping unit; and based on the buoyant rod weight value and the pump depth value, determine a rod diameter estimate of the rod string, the rod diameter estimate or an associated value to be used to calibrate the pumping unit or to verify an accuracy of values at a rod pump controller.

25. The apparatus of claim 24, wherein the processor is to obtain a rod string designation associated with a tapered rod string or a constant diameter rod string.

26. The apparatus of claim 24, wherein the processor is to obtain a diameter of a portion of the rod string based on the rod diameter estimate.

27. The apparatus of claim 26, wherein the processor is to determine a second dimension of the rod string, wherein the second dimension includes a length based on the rod diameter estimate and the pump depth value.

* * * * *